US006287095B1

(12) United States Patent
Saputo et al.

(10) Patent No.: US 6,287,095 B1
(45) Date of Patent: Sep. 11, 2001

(54) INTERNAL AIR PUMP FOR INFLATABLES

(75) Inventors: Richard A. Saputo, Tarzana, CA (US); Hua Hsiang Lin, Kowloon (HK)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 09/347,717

(22) Filed: Jul. 5, 1999

(51) Int. Cl.[7] ..... F04B 43/00; A47C 27/08
(52) U.S. Cl. ..... 417/472; 5/708
(58) Field of Search ..... 417/472; 5/708, 5/706; 92/92, 89, 90, 34

(56) References Cited

U.S. PATENT DOCUMENTS

| | | | | |
|---|---|---|---|---|
| 2,372,218 | * | 3/1945 | Manson et al. | 5/348 |
| 2,686,006 | * | 8/1954 | Hasselquist | 230/160 |
| 2,772,692 | | 12/1956 | Russell | 137/223 |
| 3,042,941 | * | 7/1962 | Marcus | 5/348 |
| 3,068,494 | | 12/1962 | Pinkwater | 5/348 |
| 3,112,502 | | 12/1963 | Forsberg | 5/348 |
| 3,133,696 | * | 5/1964 | Mirando | 230/160 |
| 3,155,991 | | 11/1964 | Dunham | 5/348 |
| 3,995,653 | | 12/1976 | Mackal et al. | 137/234 |
| 4,015,622 | | 4/1977 | Pagani | 137/223 |
| 4,521,166 | * | 6/1985 | Phillips | 417/478 |
| 4,536,136 | | 8/1985 | Lan . | |
| 4,694,515 | | 9/1987 | Rogers, Jr. | 5/13 |
| 4,930,174 | | 6/1990 | Hunter | 5/454 |
| 5,632,055 | * | 5/1997 | Graf | 5/706 |
| 5,675,855 | | 10/1997 | Culp | 5/709 |
| 5,711,041 | | 1/1998 | Chen | 5/708 |
| 5,746,873 | * | 5/1998 | Graf | 156/274.4 |

FOREIGN PATENT DOCUMENTS 0731304 9/1996 (EP) .

* cited by examiner

*Primary Examiner*—Timothy S. Thorpe
*Assistant Examiner*—Timothy P. Solak
(74) *Attorney, Agent, or Firm*—Lewis, D'Amato, Brisbois & Bisgaard, LLP

(57) ABSTRACT

An internal air pump for charging inflatables with air and method therefore is disclosed which is directed to an air pump mounted internal to an inflatable device for injecting air therein. The inventive air pump is a thin-walled, lightweight, highly elastic, flexible plastic construction which is easily packaged within the inflatable device and can be used to inflate the device to a desired air pressure. In its most fundamental embodiment, the internal air pump comprises a construction including an outer shell layer having a continuous sidewall, a roof layer and a floor layer for defining an enclosed inner pump chamber. An inner sandwich layer is positioned adjacent to the outer shell layer and includes a resilient component. At least one air intake valve is mounted within the roof layer for admitting air into the inner pump chamber. One or more exhaust ducts are mounted in the outer shell layer for discharging air from the inner pump chamber to an inflatable device. An external force applied to the air pump forces air from the inner pump chamber to the exhaust ducts. The resilient component enables the air pump to self-adjust after the external force is removed.

16 Claims, 5 Drawing Sheets

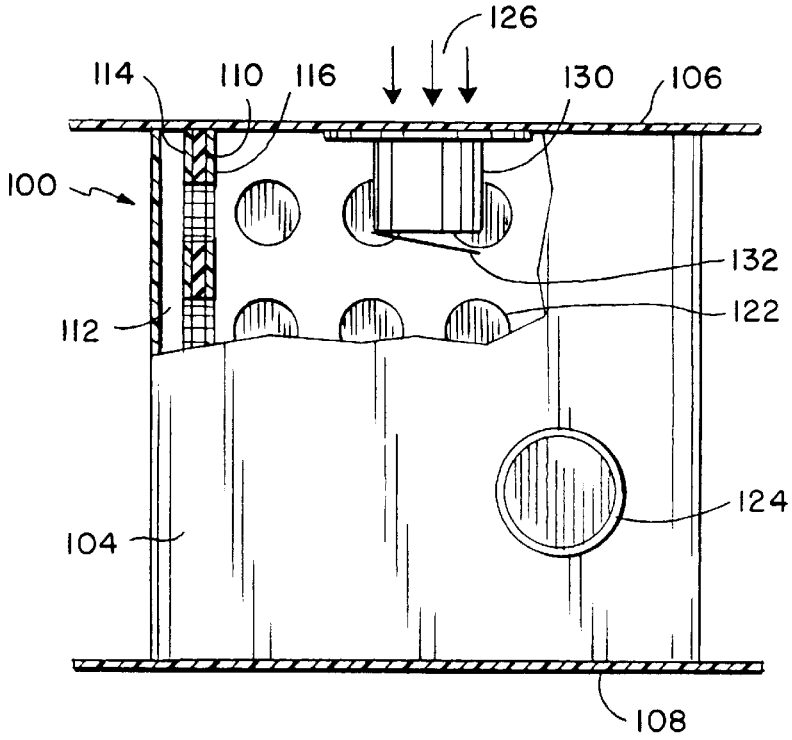
FIG. 3
FIG. 4
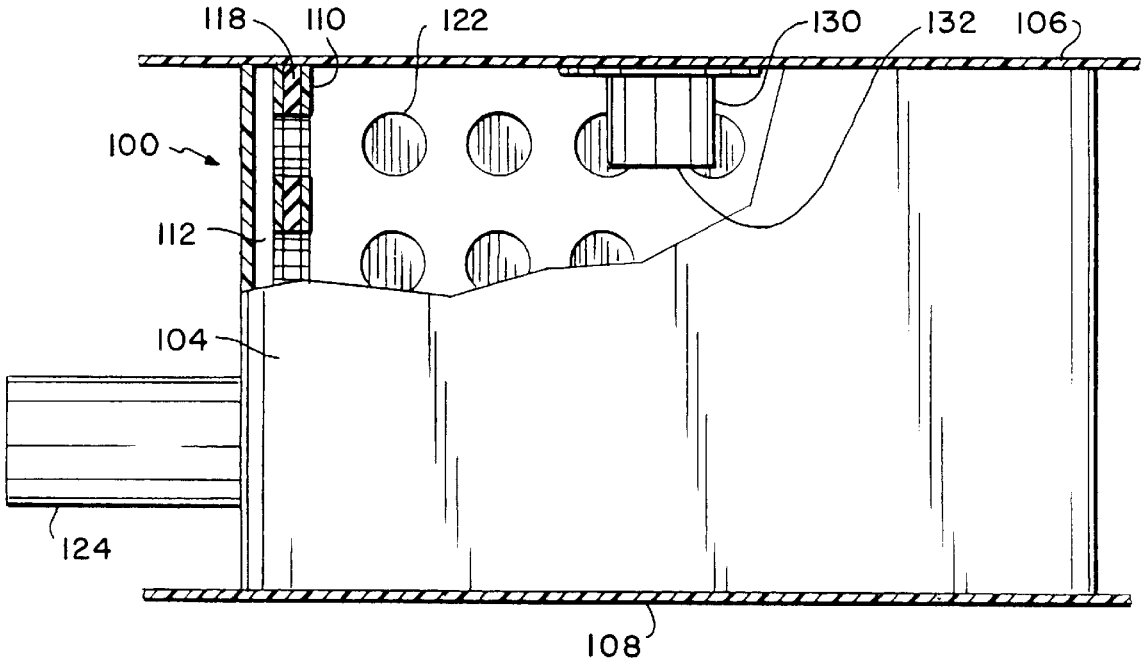

INTERNAL AIR PUMP FOR INFLATABLES

BACKGROUND OF THE INVENTION

1. Field of the Invention

The present invention relates to air pumps. More specifically, the present invention relates to methods and apparatus for an internal air pump for use with inflatables, i.e., inflatable devices, such as an air mattress, and which includes a thin-walled, highly elastic, lightweight, robust, durable, flexible plastic construction which is self-adjusting and highly reliable against failure.

2. Description of the Prior Art

The prior art is directed to methods and apparatus for internal air pumps for use with inflatable devices such as, for example, air mattresses. The use of inflatable devices fabricated from modern lightweight plastics has increased in recent years. Inflatable devices are now typically found in camping equipment, residential and beach air inflatable furniture, swimming pool lounging equipment, watercraft and the like. Therefore, advances in means for inflating the myriad of inflatable devices has occurred.

Inflatable devices and objects known in the past were often comprised of heavy gauge plastic, rubberized and other synthetic materials which were not convenient to inflate and transport. Typically, an external air pump was required in order to inflate these devices prior to their use. These inflatable devices included an externally accessible air valve which was compatible with the external air pump used to inflate the device. Likewise, after use, it was necessary to exhaust the air pumped into the inflatable device prior to disassembly and storage thereof.

With the advent of lightweight, robust plastic materials now utilized to fabricate inflatable devices, modifications in the manner in which these devices were inflated have occurred. Generally, designs referred to as foam spring or foam activated air pumps, in block form, which are employed as the air pumping mechanism have been known. Each of these designs have certain characteristics in common which include (a) the foam spring or foam activated mechanism is positioned within a small air chamber or housing of the air pump which in turn is located within an outer larger air mattress chamber, and (b) each of these foam spring type pumps have an intake port and an exhaust port for the intake and exhaust of air.

In a first example, an air mattress is disclosed including a pump contained within an inflatable chamber. The pump is in fluid communication with the inflatable chamber via intake and exhaust ports. One way valves positioned on the intake and exhaust ports of the pump control the flow of air from the pump to the inflatable chamber of an air mattress. The pump contains a solid block of resilient, closed-cell foam pump material which functions as a piston head pushing air out of the exhaust duct and into the inflatable mattress. When foot pressure is released, the slightly compressed solid block of foam is released, the air intake valve opens to draw air into the inner housing and the exhaust valve closes.

In a second example, an air mattress is disclosed that incorporates within it a pump having a variable volume chamber formed by a flexible sheeting material. Located within the chamber is a large block of open-cell foam material which biases the chamber to its maximum volume. An air outlet incorporating a one way valve restricts air to move outwardly from within the chamber while an air inlet is maintained clear during a pumping operation and is selectively closed by the hand of the operator. On a compression cycle, the foot forces the large block of open-cell foam material down to force air out of the exhaust port to the inflatable device. On release of the foot, the foam block recovers and the valves operate to open the intake port and close the exhaust port.

In another example, a self-inflating air mattress is disclosed which includes an air chamber and a foam panel therein. The air chamber is defined by top and bottom sheet panels and a valve allowing air passage into and out of the air chamber. The foam panels includes apertures therethrough and the top and bottom sheet panels are mechanically coupled directly together via the apertures in the foam panel. As a result, the foam panel need not be mechanically coupled to the top and bottom sheet panels and improved air flow within the chamber results. In a further example, an air mattress is disclosed which comprises an inflatable and deflatable flexible body enclosing an air chamber having a resilient means urging the opposite upper and lower walls of the body apart while being yieldable to permit the body to be folded and deflated.

In a final example, an air pump is disclosed which includes a number of inflatable chambers which form a closed container for defining a pumping chamber. The container is fitted with one-way inlet and outlet valves to effectuate the pumping operation. In one embodiment, the container is cylindrical with seven to nine longitudinal air chambers forming the walls of the chamber. The ends of the cylindrical container are fitted with the inlet and outlet valves.

Thus, there is a need in the art for an internal air pump for inflatable devices which exhibits a thin-walled, highly elastic, lightweight, robust, durable, flexible plastic construction in which the entire air pump is self-adjusting and highly reliable against failure, enables inflation of the inflatable device to specific air pressures, and incorporates a design that maximizes the air volume exhausted from the pump to the inflatable device.

SUMMARY OF THE INVENTION

Briefly, and in general terms, the present invention provides a new and improved internal air pump for use in inflatables, i.e., inflatable devices. The internal air pump is housed within an inflatable device such as, for example, an air mattress but can also be used for injecting air into an article of inflatable furniture, inflatable watercraft or an above-the-ground swimming pool having inflatable sides. Further, the internal air pump is intended to be convenient to use since it is operated by the pumping action of the foot of an individual. The novel and non-obvious internal air pump generally is located within the inflatable device at a location which will not interfere with the operation thereof. Further, the internal air pump exhibits a thin-walled, highly elastic, lightweight, durable, flexible plastic construction. The air pump is self-adjusting during each cycle to prepare for the next cycle. Because of its robust construction, the air pump is highly reliable against failure, enables inflation to specific air pressures, and incorporates a design that maximizes the air volume exhausted from the pump to the inflatable device.

The inventive internal air pump for inflatables exhibits a generally rectangular shape but can adopt an oval or other suitable shape. The air pump includes a thin-wall, flexible outer shell layer having a continuous sidewall that serves as a housing for the interior components. A roof layer and a floor layer are added to the outer shell layer to complete an enclosure. A sandwich layer is positioned inside the outer shell layer and includes a resilient polymeric material that provides the self-adjusting memory to the air pump. One or more air intake valves are mounted within the roof layer and one or more exhaust ducts are connected to the outer shell layer for injecting air into the inflatable device.

The present invention is generally directed to an air pump mounted internal to an inflatable device for injecting air therein. The inventive air pump is lightweight and easily packaged within the inflatable device and can be used to inflate the device to a desired air pressure. In its most fundamental embodiment, the internal air pump comprises a construction including an outer shell layer having a continuous sidewall, a roof layer and a floor layer for defining an enclosed inner pump chamber. An inner sandwich layer is positioned adjacent to the outer shell layer and includes a resilient component. At least one air intake valve is mounted within the roof layer for admitting air into the inner pump chamber. Further, one or more exhaust ducts are mounted in the outer shell layer for discharging air from the inner pump chamber to an inflatable device. An external force applied to the air pump forces air from the inner pump chamber to the exhaust ducts. The resilient component enables the air pump to self-adjust after the external force is removed.

In a preferred embodiment, a passageway is formed between the outer shell layer and the inner sandwich layer. Additionally, a plurality of perforations are formed through the sandwich layer. The combination of the plurality of perforations and the passageway provide an alternative pathway for exhausting air from the inner pump chamber to the exhaust ducts when the external force is applied to the air pump. This alternative pathway is in addition to the direct pathway that exists from the inner pump chamber directly to the exhaust ducts via the perforations. Thus, exhausting of air from the inner pump chamber is maximized which improves the efficiency of the air pump in charging the inflatable device with air. Additionally, the preferred embodiment includes a threaded cap for mating with the top of the threaded air intake port mounted within the roof layer of the air pump. The cap ensures that air leakage from the inner pump chamber through the air intake valve flap will be prevented. Finally, most of the components of the preferred embodiment of the internal air pump are comprised of Polyvinylchloride (PVC) which is lightweight, flexible and robust. Other suitable polymeric materials can also be used.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 3 is a rear elevational view of the internal air pump of FIG. 1 having a cutaway for showing the outer shell layer, the sandwich layer, the plurality of perforations formed in a rear sandwich layer, the air intake valve, one of the multiple exhaust ducts, and the roof and a floor of the internal air pump.

FIG. 4 is a side elevational view of the internal air pump of FIG. 1 having a cutaway for showing the outer shell layer, the sandwich layer, the plurality of perforations formed in a side sandwich layer, the air intake valve, one of the multiple exhaust ducts, and the roof and floor of the internal air pump.

DESCRIPTION OF THE INVENTION

The present invention is an internal air pump 100 for use in charging inflatables, i.e., an inflatable device 102 with air and method therefore as shown in FIGS. 1–6 herein. The inflatable device 102 can include any of various inflatables which must be charged with air or other gas in order to be functional. In the preferred embodiment of the present invention, the inflatable device 102 is illustrated as an air mattress. However, the inflatable device 102 could also be an article of air inflatable furniture, an air inflatable watercraft, or an above-the-ground swimming pool having inflatable sides.

Figure 1:
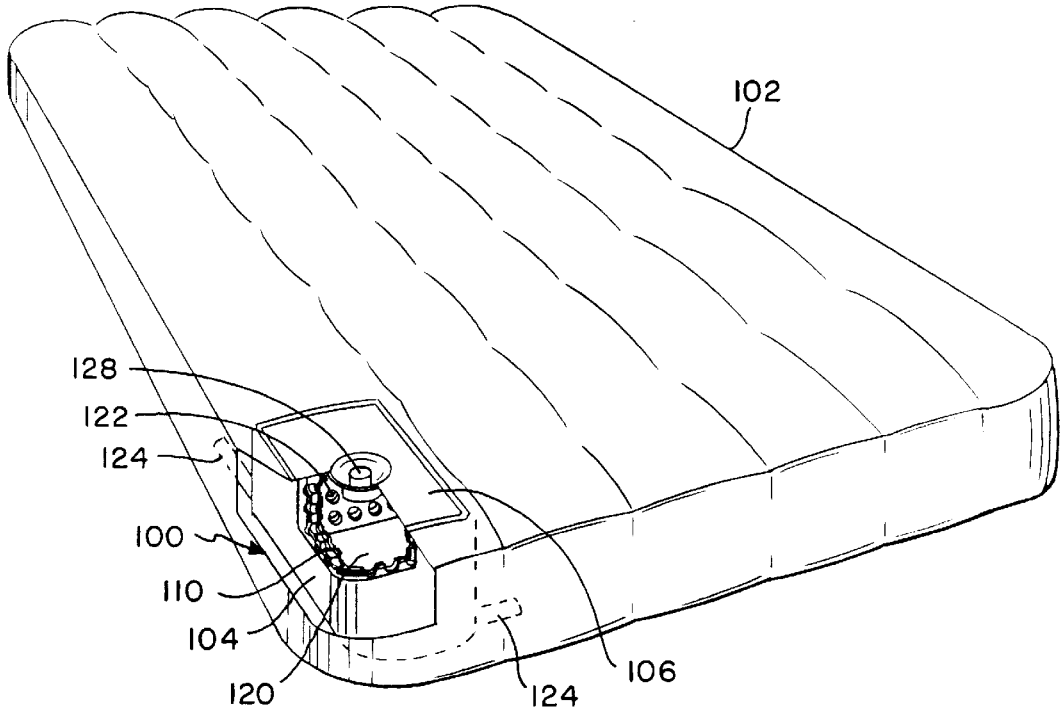
FIG. 1 is a perspective view of an internal air pump for inflatables of the present invention having a cutaway for showing an outer shell layer, a sandwich layer including an inner resilient component which approximates the boundary of an inner chamber, an air intake port, and multiple air exhaust ducts shown in phantom, the internal air pump shown illustrated in a suitable environment such as an inflatable mattress.

It is significant to note that the internal air pump 100 of the present invention is positioned within, i.e., incorporated within, the inflatable device 102 as is shown in FIG. 1. Further, the air pump 100 can be located within the inflatable device 102 so as not to interfere with the functionality of the inflatable device 102. For example, the air pump 100 shown in FIG. 1 is positioned in the lower left corner of the inflatable device 102 i.e., the air mattress. In this example, positioning the air pump 100 in the corner of the air mattress reduces the possibility that the sleeping posture of a person reclining thereon will be affected.

The application shown in FIG. 1 illustrates the situation in which a single air pump 100 is utilized to charge with air the entire volume of the inflatable device 102, i.e., the air mattress. However, the volume of the air mattress could be subdivided into isolated chambers with an air pump 100 placed internally in each isolated chamber. This configuration would result in multiple air pumps 100 being placed in a single inflatable device 102. Notwithstanding the number of air pumps 100 which are placed in a single inflatable device 102, each can be conveniently operated manually. In the preferred embodiment, it is intended that each of the air pumps 100 be operated by employing a pumping action with the foot of an individual. However, each of the air pumps 100 could also be operated by utilizing either a hand, an arm or other body part.

Continuing to refer to FIG. 1 but more particularly to FIG. 2, a preferred embodiment of the internal air pump 100 will now be described. In general, the air pump 100 is normally classified as an elastic polymer pump. This category of pump is subjected to the application of force such as foot pressure in order to initiate an operation cycle of the pump. Additionally, this category of pump is characterized by a resilient action at the end of each cycle that enables the pump construction to "self-adjust", i.e., to revive or reconfigure itself after foot pressure has be applied to and then removed from the air pump 100. This self-adjusting action is made possible by incorporating a resilient component such as, for example, natural rubber, synthetic rubber, latex, foam, ethylene vinyl acetate (EVA), polyurethane or the like into the pump construction. These resilient materials include a long term memory which enable the air pump 100 to experience thousands of cycles prior to failure.

The internal air pump 100 of the present invention includes an outer shell layer 104 which is typically comprised of any suitable soft, flexible polymeric material. In the preferred embodiment, the outer shell layer 104 is comprised of polyvinylchloride (also known as PVC). The outer shell layer 104 is formed in the shape of a continuous sidewall having a defined vertical dimension as shown in FIG. 2. The continuous sidewall clearly implies that the outer shell layer 104 is closed upon itself, i.e., it defines a closed space. The defined vertical dimension of the outer shell layer 104 indicates that the vertical dimension is limited by some parameter. The limiting parameter is the height of the inflatable device 102, i.e., the air mattress, since the air pump 100 is positioned therein.

Figure 2:
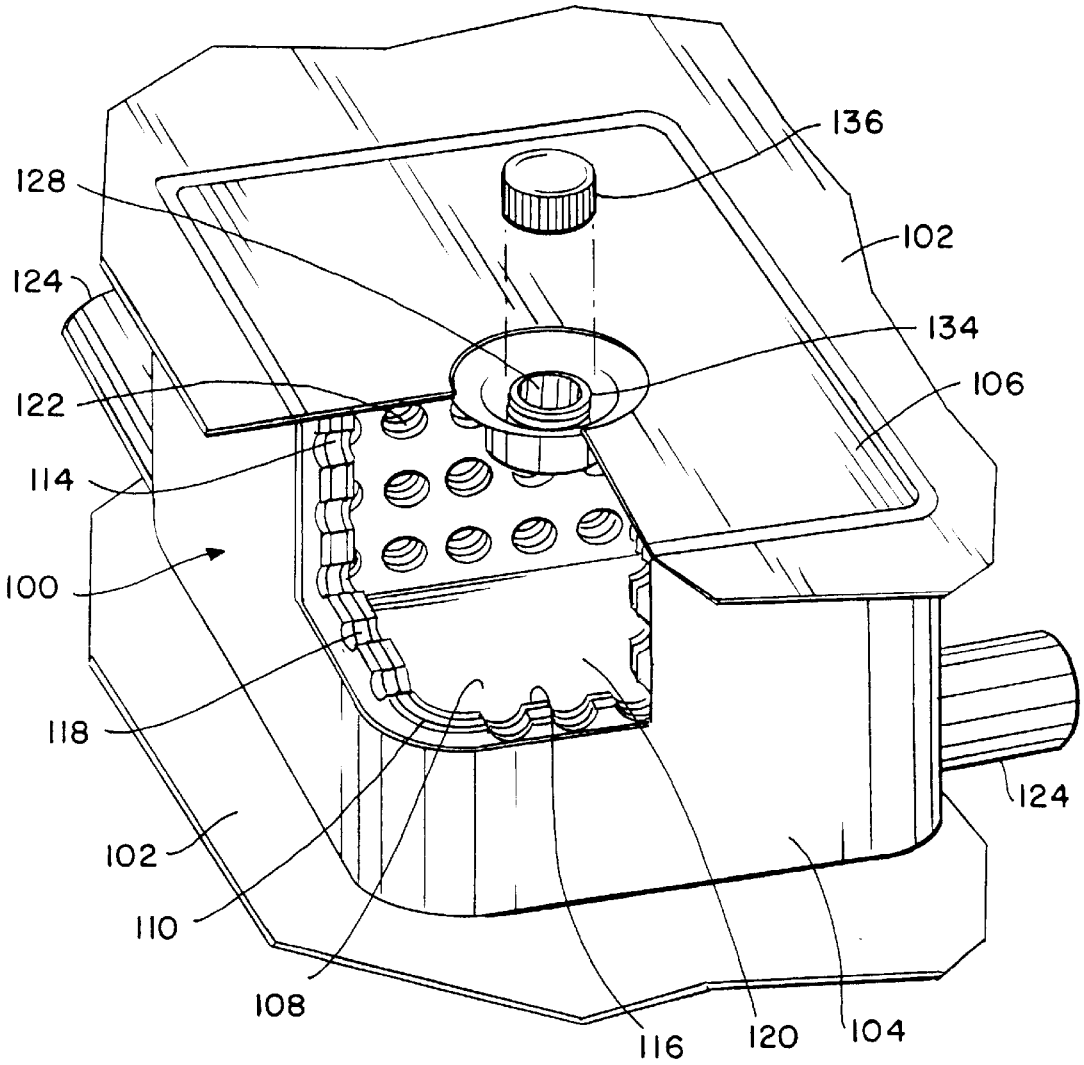
FIG. 2 is an enlarged front perspective view of the internal air pump of FIG. 1 showing more clearly the outer shell layer, the sandwich layer positioned inside the outer shell layer and approximating the boundary of the inner chamber, a plurality of perforations formed in the sandwich layer, the air intake valve mounted in the roof of the internal air pump, and the multiple exhaust ducts connected to the outer shell layer.
Figure 5:
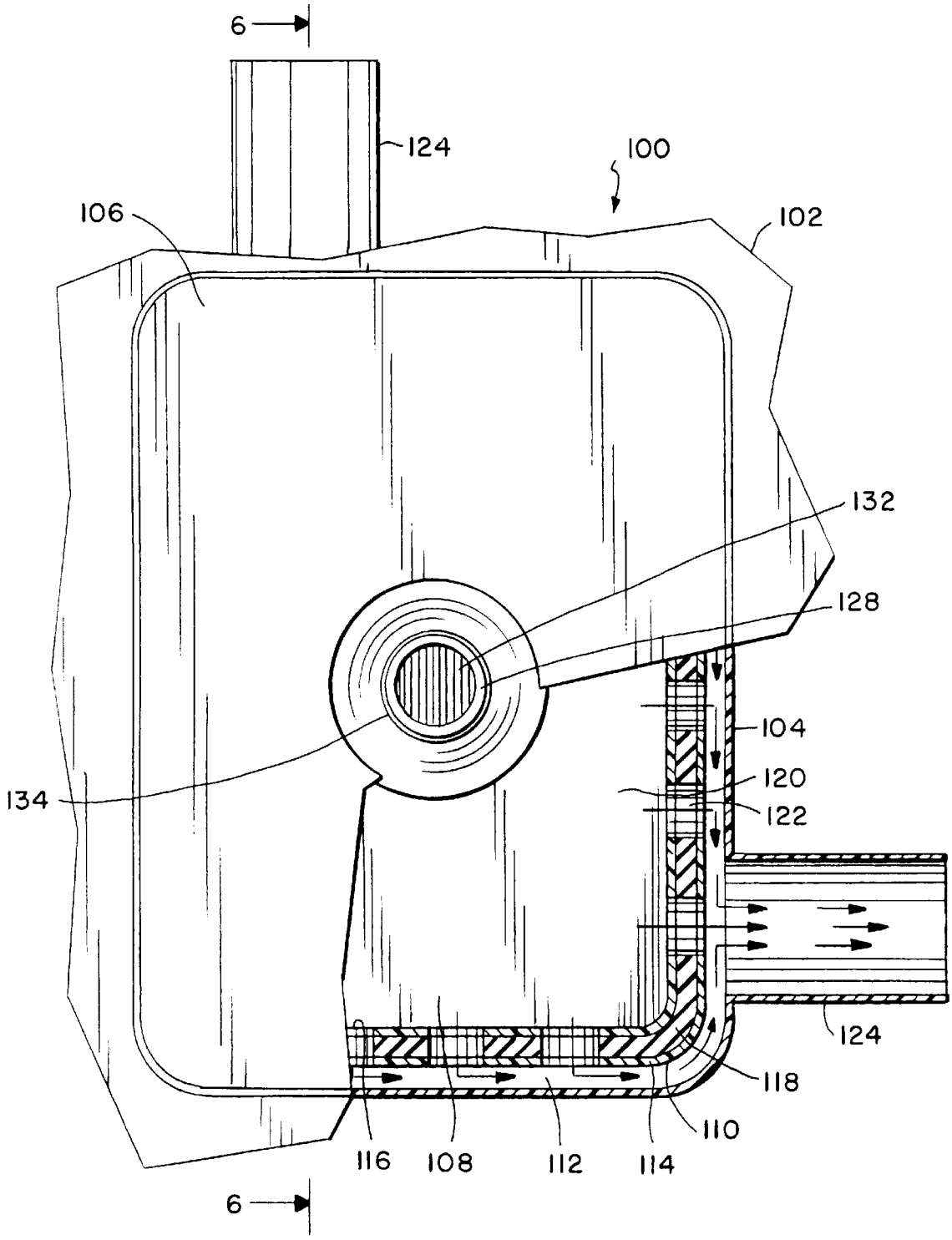
FIG. 5 is a top planar view of the internal air pump of FIG. 1 having a cutaway for showing the inner pump chamber surrounded by the sandwich layer and the outer shell layer, the air intake valve mounted in the roof of the internal air pump and the pair of exhaust ducts mounted in the outer shell layer.
Figure 6:
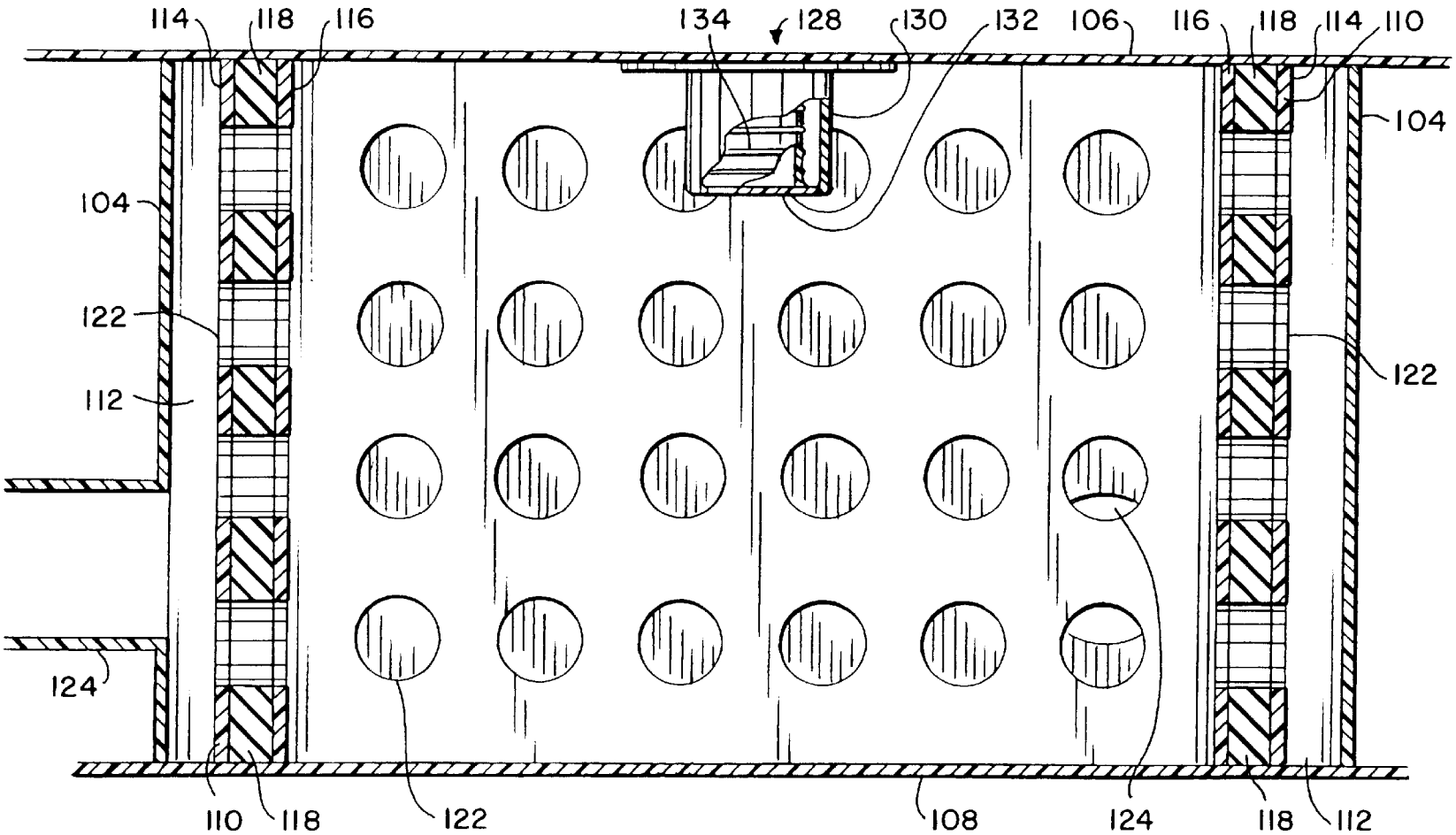
FIG. 6 is an enlarged cross-sectional view of the internal air pump of FIG. 1 taken along the longitudinal axis line 6—6 of FIG. 5 showing the outer shell layer, the sandwich layer including the plurality of perforations formed therein, a cutaway of the air intake valve, the roof and floor of the internal air pump, and portions of each of the multiple air exhaust ducts.

The outer shell layer 104 includes a roof layer 106 and a floor layer 108 best shown in FIG. 2 but also shown in FIGS. 3, 4 and 6. The roof layer 106 and the floor layer 108 are each comprised of a soft, flexible polymeric material such as polyvinylchloride (PVC) so that they are each compatible with the outer shell layer 104. The roof layer 106 can be a separate layer of PVC that is sealed to the top of the outer shell layer 104 as by Radio Frequency (RF) sealing or by heat sealing or by ultrasound techniques, each well known in the art. Likewise, the floor layer 108 can be a separate layer of PVC that is sealed to the bottom of the outer shell layer 104 by similar RF, heat or ultrasound sealing techniques. The outer shell layer 104 and the separate roof layer 106 and floor layer 108 thus form the boundaries of the air pump 100 as shown in FIGS. 2 and 5. The air pump 100 is then positioned within the inflatable device 102 in this configuration.

In order to best utilize the resources available, the top and bottom surfaces of the inflatable device 102 as shown in FIG. 1 and FIG. 2 are employed as the roof layer 106 and the floor layer 108. In FIG. 1, the top of the inflatable device 102, i.e., the air mattress, is positioned above the outer shell layer 104. Likewise, the bottom of the inflatable device 102, i.e., the air mattress, is positioned underneath the outer shell layer 104. Since both the inflatable device 102 and the outer shell layer 104 are comprised of a flexible polymeric material such as polyvinylchloride, they can be conveniently bonded together as by RF sealing to form the boundaries of the air pump 100. This construction is clearly illustrated in FIG. 2 which shows that the material comprising the top surface of the inflatable device 102 is continuous with the material forming the roof layer 106. Likewise, the material comprising the bottom surface of the inflatable device 102 is continuous with the material forming the floor layer 108. Thus, the internal air pump 100 becomes integrated with the inflatable device 102 resulting in a more economical design.

Positioned adjacent to the outer shell layer 104 is an inner sandwich layer 110 as is shown in FIGS. 2–6. The inner sandwich layer 110 is positioned just inside and adjacent to the outer shell layer 104. As is shown in FIG. 2, the inner sandwich layer 110 extends over and covers only the inner vertical surface of the outer shell layer 104. Located between the outer shell layer 104 and the inner sandwich layer 110 is a narrow air passageway 112 best shown in FIG. 5 but also shown in FIGS. 3, 4 and 6. The air passageway 112 will be discussed in more detail hereinbelow with regards to FIG. 5.

The inner sandwich layer 110 is comprised of three component layers. A first sheet layer 114 is positioned closest to the inner vertical surface of the outer shell layer 104 as is shown in FIGS. 2, 5 and 6. A second sheet layer 116 is positioned parallel to the first sheet layer 114 and furtherest from the inner surface of the outer shell layer 104. Both the first sheet layer 114 and the second sheet layer 116 are comprised of a soft, flexible polymeric material such as polyvinylchloride (PVC). Positioned between the first sheet layer 114 and the second sheet layer 116 is a resilient component 118 best shown in FIGS. 5 and 6. The function of the first sheet layer 114 and the second sheet layer 116 is to sandwich the resilient component 118 to provide support thereto and to maintain the resilient component 118 in a vertical position. This objective is achieved by RF sealing the top and bottom surfaces of the first sheet layer 114 and the second sheet layer 116 to the roof layer 106 and the floor layer 108, respectively, as is shown in FIGS. 3, 4 and 6. Each of these components are comprised of flexible polymeric materials and thus are compatible for bonding. However, the resilient component 118 which is formed from natural or synthetic rubber, latex, foam, EVA or polyurethane, although sandwiched, is not bonded to either the first sheet layer 114 or the second sheet layer 116.

The inner sandwich layer 110 with the resilient component included therein is thus held in a vertical orientation with respect to the interior of the inflatable device 102, i.e., the air chamber. This construction prevents the resilient component 118 from drifting out of position and collapsing between the first sheet layer 114 and the second sheet layer 116. The inner sandwich layer 110 including the resilient component 118 extends over and covers only the inner vertical surface of the outer shell layer 104.

The combination of the outer shell layer 104, the adjacent inner sandwich layer 110, the roof layer 106 and the floor layer 108 generally forms the boundary of an inner pump chamber 120 as is best shown in FIGS. 2 and 5. In the present invention, the inner pump chamber 120 exhibits a generally rectangular shape having four walls. However, the shape of the inner pump chamber can be circular or even oval. Each of the vertical surfaces of the inner pump chamber 120 is an inner sandwich layer 110 as is shown in FIGS. 2 and 6. Thus, the inner pump chamber 120 includes front, rear, left and right sides of the inner sandwich layer 110 to provide the generally rectangular shape.

The inner sandwich layer 110 includes a plurality of perforations 122 formed therein. It is noted that the perforations 122 are formed only through the inner sandwich layer 110 and not through the outer shell layer 104. The function of the plurality of perforations 122 formed in the inner sandwich layer 110 is to provide a pathway for directing air from the inner pump chamber 120 to one or more exhaust ducts 124. The air pump 100 will function properly with only a single exhaust duct 124. However, for convenience, the preferred embodiment describes a pair or a plurality of exhaust ducts 124. In either case, the exhaust ducts 124 are connected to the outer shell layer 104 (via RF, heat, or ultrasound sealing techniques) as is clearly shown in FIGS. 3–6. The exhaust ducts 124 are typically comprised of a robust tubular, flexible polymeric material such as polyvinylchloride (PVC). In the absence of foot pressure (indicated by the number 126 on FIG. 3) or when all the air in the inner pump chamber 120 is exhausted, the PVC exhaust ducts 124 collapse upon themselves to discontinue air transmission therethrough. Thus, the exhaust ducts 124 are self-closing.

In a preferred embodiment, the exhaust ducts 124 connect to corresponding exhaust ports formed within the outer shell layer 104. When foot pressure 126 is applied to the air pump 100, the air pressure within the inner pump chamber 120 increases. Exhausting air from the inner pump chamber 120 to the exhaust ducts 124 can be accomplished by either of two routes. In the direct route, the increased pressure within the inner pump chamber 120 is forced through those perforations 122 aligned with one of the plurality of exhaust ducts 124. Under these conditions, the pressurized air forces the exhaust duct 124 to open and to pass the exhaust air therethrough.

In an alternative route, air is also forced through other of the plurality of perforations 122 and enters the narrow air passageway 112 clearly shown in FIG. 5. The air passageway 112 positioned between the outer shell layer 104 and the inner sandwich layer 110 is connected directly to the plurality of exhaust ducts 124. Consequently, air entering the narrow air passageway 112 via the perforations 122 is also forced out of the exhaust ducts 124. Once the air has been exhausted from the inner pump chamber 120 to the inflatable device 102, the PVC exhaust ducts 124 once again collapse upon themselves (self-closing) to discontinue air transmission therethrough. Thus, when foot pressure 126 is applied to the air pump 100, the two routes for exhausting air maximizes the air volume exhausted from the inner pump chamber 120 to the inflatable device 102. It is noted that in the alternative, any type of one-way exhaust valve can be included to close the exhaust ducts 124 once the foot pressure 126 has been removed.

Intake air is introduced into the inner pump chamber 120 of the internal air pump 100 via an air intake port 128 as is clearly shown in FIGS. 2, 5 and 6. The air intake port 128 is seated above an air intake valve 130 as is best shown in FIGS. 3 and 6. Although the preferred embodiment shows a single air intake port 128 and a single air intake valve 130, it is to be understood that two or more air intake ports 128 and air intake valves 130 can be incorporated into the air pump 100. The air intake valve 130 is of a type known in the art and can include a generally cylindrical construction including a hinged flap 132 connected to the bottom thereof (i.e., hinged from one side of the bottom of the air intake valve 130) as is shown in FIGS. 3, 4 and 6. The hinged flap 132 is the component that opens and closes the air intake valve 130 as a function of the air pressure existing within the inner pump chamber 120. The hinged flap 132 can be a thin layer of a flexible polymeric material such as polyvinylchloride.

When the inflatable device 102, i.e., the air mattress, is not being used, the hinged flap 132 is pulled downward by gravity causing the intake valve 130 to be slightly open. If thereafter, a foot is positioned over and applies pressure 126 onto the roof layer 106 of the internal air pump 100 as shown in FIG. 3, the air pressure inside the inner pump chamber 120 increases. Under these conditions, the hinged flap 132 is forcibly moved upward to close by back pressure created inside the inner pump chamber 120 (see FIGS. 4 and 6) which also closes the intake valve 130. Thereafter, the increased pressure inside of the inner pump chamber 120 causes the normally closed exhaust ducts 124 to open. Air is then exhausted through the exhaust ducts 124 directly from the inner pump chamber 120 and through the exhaust ducts 124 from the narrow air passageway 112. It is to be understood that during the exhaust cycle, the entire air pump including the outer shell layer 104, the inner sandwich layer 110 and the inner pump chamber 120 is collapsed.

At the end of the exhaust cycle, the entire air pump 100 is collapsed under the foot pressure 126. When the foot pressure 126 is removed, the recovery cycle is initiated. At the beginning of the recovery cycle, the inner pump chamber 120 is a partial vacuum (i.e., somewhat less than atmospheric pressure) as the back pressure has been removed during the exhausting of air. Simultaneously, the resilient component 118 of the inner sandwich layer 110 positioned at the boundary of the inner pump chamber 120 and which has been collapsed, begins to self-adjust or revive. The resilient component 118 assists the collapsed inner pump chamber 120 to reconfigure its rectangular shape. Also, since the back pressure has been removed, air will tend to be drawn into the inner pump chamber 120 through the air intake valve 130. Thus, air at atmospheric pressure moving into the air intake port 128 will force the hinged flap 132 of the intake valve 130 to open. The opening of the intake valve 130 begins the admission of air into the inner pump chamber 120. As the inner pump chamber 120 begins to inflate, the exhaust ducts 124 will self-close by collapsing.

Thus, during the recovery cycle, the resilient component 118 causes the inner pump chamber 120 to (a) self-adjust and to (b) fill with atmospheric air passing through the air intake valve 130. After the inner pump chamber 120 has reached the recovery position with the assistance of the resilient component 118 and has also filled with air, the air intake valve 130 closes (or remain partially open due to gravity). However, it is understood that the plurality of perforations 122 always remain open. The internal air pump is now reset for the next exhaust cycle to inject air into the inflatable device 102. Applying foot pressure 126 onto the roof layer 106 of the air pump 100 will initiate the next exhaust cycle.

The air intake port 128 is recessed and the top thereof is seated approximately flush with the roof layer 106 as is shown in FIG. 2. The intake port 128 includes a plurality of threads 134 (see FIGS. 2 and 6) which mate with corresponding threads (not shown) formed on an inside wall of a threaded cap 136 also shown in FIG. 2. The threaded cap 136 is useful for sealing the top of the air intake valve 130 when, for example, the internal air pump 100 is not being utilized. The air pump 100 would typically not be used when the inflatable device 102, i.e., the air mattress, is supporting the weight of an individual reclining thereon. In use, the cap 136 would be threaded onto the plurality of threads 134 of the air intake port 128. This action ensures that there is no air leakage past the hinged flap 132 of the air intake valve 130. Thereafter, the threaded cap 136 would be removed to pump air into the inflatable device 102.

The present invention provides novel advantages over other air pumps utilized for inflatable objects known in the art. A main advantage of the internal air pump 100 of the present invention is that it is a thin-walled, highly elastic, lightweight, internally positioned air pump that is highly reliable against failure and is easily packaged within the inflatable device 102. Additionally, the internal air pump 100 comprises a robust, durable, flexible plastic construction in which the entire air pump is self-adjusting, enables inflation of the inflatable device to specific air pressures, and incorporates a design that maximizes the air volume exhausted from the pump to the inflatable device.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. An internal air pump for use with inflatables comprising:

an outer shell layer having a continuous vertical sidewall, a roof layer and a floor layer for defining an enclosed inner pump chamber;

an inner sandwich layer positioned inside an inner surface of said vertical sidewall of said outer shell layer for defining a volume boundary around said inner pump chamber, said inner sandwich layer including a resilient component;

an air intake valve mounted within said roof layer for admitting air into said inner pump chamber; and a plurality of exhaust ducts mounted in said outer shell layer for discharging air from said inner pump chamber to an inflatable, wherein an external force applied to said air pump forces air from said inner pump chamber to said exhaust ducts, and said resilient component enabling said air pump to spring-back after said external force is removed.

2. The internal air pump of claim 1 wherein said outer shell layer is comprised of a flexible polymeric material.

3. The internal air pump of claim 1 wherein said roof layer is comprised of a flexible polymeric material.

4. The internal air pump of claim 1 wherein said floor layer is comprised of a flexible polymeric material.

5. The internal air pump of claim 1 wherein said sandwich layer comprises said resilient component positioned between a first sheet layer and a second sheet layer.

6. The internal air pump of claim 5 wherein said first sheet layer and said second sheet layer are each bonded to said roof layer and said floor layer.

7. The internal air pump of claim 1 wherein said resilient component in said sandwich layer is comprised of a polymeric material.

8. The internal air pump of claim 1 wherein said inner sandwich layer includes a plurality of perforations for maximizing the air exhausted from said inner pump chamber to said exhaust ducts.

9. The internal air pump of claim 1 wherein said air intake valve includes a threaded cap for sealing said inner pump chamber against air leakage when said air pump is not in use.

10. The internal air pump of claim 1 further including a passageway located between said outer shell layer and said sandwich layer for passing air from said inner pump chamber to said exhaust ducts via a plurality of perforations formed within said sandwich layer.

11. The internal air pump of claim 1 wherein said air intake valve includes a flexible flap that is positioned in accordance with the air pressure within said inner pump chamber.

12. The internal air pump of claim 1 wherein said plurality of exhaust ducts is comprised of a flexible polymeric material.

13. An internal air pump for use with inflatables comprising:

an outer shell layer having a continuous vertical sidewall, a roof layer and a floor layer for defining an enclosed inner pump chamber;

an inner sandwich layer positioned inside an inner surface of said vertical sidewall of said outer shell layer for defining a volume boundary around said inner pump chamber, said inner sandwich layer including a resilient component and a plurality of perforations formed therein;

an air intake valve mounted within said roof layer for admitting air into said inner pump chamber; and an exhaust duct mounted in said outer shell layer for discharging air from said inner pump chamber to an inflatable, wherein an external force applied to said air pump forces air from said inner pump chamber to said exhaust duct, and said resilient component enabling said air pump to spring-back after said external force is removed.

14. The internal air pump of claim 13 wherein said resilient component of said inner sandwich layer is comprised of a polymeric material.

15. An internal air pump for use with inflatables comprising:

an outer shell layer having a continuous vertical sidewall, a roof layer and a floor layer for defining an enclosed inner pump chamber;

an inner sandwich layer positioned inside an inner surface of said vertical sidewall of said outer shell layer for defining a volume boundary around said inner pump chamber, said inner sandwich layer including a resilient component comprised of a polymeric material;

an air intake valve mounted within said roof layer for admitting air into said inner pump chamber; and at least one exhaust duct mounted in said outer shell layer for discharging air from said inner pump chamber to an inflatable, wherein an external force applied to said air pump forces air from said inner pump chamber to said exhaust duct, and said resilient component enabling said air pump to spring-back after said external force is removed.

16. The internal air pump of claim 15 wherein said inner sandwich layer includes a plurality of perforations for maximizing the air exhausted from said inner pump chamber to said exhaust duct.

* * * * *